US007803005B1

(12) United States Patent
Speaker, IV

(10) Patent No.: US 7,803,005 B1
(45) Date of Patent: Sep. 28, 2010

(54) BARBED-SHAPED CONNECTOR ELEMENTS WITH ADDITIONAL PRE-SEAL ELEMENT FOR IMPROVED HOLDING ABILITY AND MOISTURE RESISTANCE

(75) Inventor: Theodore J. Speaker, IV, Alstead, NH (US)

(73) Assignee: Whitney Blake Company, Brattleboro, UT (US)

( * ) Notice: Subject to any disclaimer, the term of this patent is extended or adjusted under 35 U.S.C. 154(b) by 0 days.

(21) Appl. No.: 12/587,691

(22) Filed: Oct. 13, 2009

(51) Int. Cl.
*H01R 13/52* (2006.01)

(52) U.S. Cl. ..... 439/278; 439/281; 439/350; 439/732

(58) Field of Classification Search ..... 439/278, 439/350, 732
See application file for complete search history.

(56) References Cited

U.S. PATENT DOCUMENTS 4,635,174 A * 1/1987 Montet ..... 362/457
4,998,891 A * 3/1991 Bresko ..... 439/369
5,254,016 A * 10/1993 Ganthier ..... 439/567
6,902,413 B1 * 6/2005 Moga ..... 439/125
7,275,949 B1 * 10/2007 Speaker, IV ..... 439/271

* cited by examiner

*Primary Examiner*—Tho D Ta
(74) *Attorney, Agent, or Firm*—Stephen W. White

(57) ABSTRACT

A coupling system that forms very high moisture resistance to connectable elements comprising a male element containing female connection points inserted into a female element containing male connection points. These made from rigid and thermoplastic materials. This system has a series of circumferentially barbed receiving grooves on the female element and circumferentially formed barb elements on the male element and designed to fit in the grooves of the female element. These grooves mate to form a first moisture barrier and a rigid lip on the male element circumferentially surrounding the female connection points, presses into a flexible face containing the male connection points on the female element to form yet another moisture barrier. Yet another improvement is the presence of a circumferentially formed shoulder on the male element designed to snugly fit into a circumferentially formed shoulder receiving element on the female. This system can be easily be connected, disconnected and reconnected a plurality of times and yet the very high moisture resistant seal is repeated. It finds good use in communications or electrical connections among others.

9 Claims, 5 Drawing Sheets

BARBED-SHAPED CONNECTOR ELEMENTS WITH ADDITIONAL PRE-SEAL ELEMENT FOR IMPROVED HOLDING ABILITY AND MOISTURE RESISTANCE

CROSS-REFERENCES TO RELATED INVENTIONS

This application is related to the invention disclosed in my U.S. Pat. No. 7,275,949, filed Dec. 14, 2006 and issued Oct. 2, 2007.

BACKGROUND OF THE INVENTION

In the area of connector elements, which is eminently described in the aforementioned U.S. Pat. No. 7,275,949, there still remains a pressing need to ensure an improved tightness of fit for improved resistance to moisture of such connector systems. My previously described device continues to satisfy all claims admirably in a moist environment but there are significant needs for devices to have even better resistance to moisture and continued ease of connection whereby the connector system can be easily connected and subsequently disconnected a plurality of times while maintaining connectability, circuit and communications continuity and high resistance to moisture with each re-connection. The ease of connection or disconnection is accomplished simply by pushing the connector halves together or pulling them apart. The moisture seal is accomplished without the use of threaded devices, loose o-rings or complicated latching mechanisms. I know of no prior art element that has been able to establish such higher resistance to moisture while maintaining ease of connection and disconnection.

SUMMARY OF THE INVENTION

I have now solved the problems of providing safe connector elements with an improved tightness of fit between male and female elements such that moisture resistance is greatly improved over any available connector system that can be found in the prior art while the continued ease of connecting and reconnecting is maintained. This solution can be found in a highly moisture resistant connector system having two coupling elements comprising:

a. a first male coupling element formed in a longitudinal end-to-end formation and having an energy transmitting line element contained and encapsulated therein, comprising in order a first end comprising said line for transmitting said energy and a second end formed longitudinally into a circular body, said circular body comprising an outer layer and an encapsulating inner layer, wherein said outer layer further contains a shoulder formed with said circular body, said inner layer further containing encapsulated longitudinally therein at least one female receiving element having two ends, one of said ends being connected to said energy transmitting line and the other of said ends terminating at a face ending on said inner layer, wherein a rigid lip is formed circumferentially on said face and wherein at least two barbed shaped elements are formed circumferentially thereon;

b. a second female coupling element formed in a longitudinal end-to-end formation and having an energy transmitting line contained and encapsulated therein, comprising in order a first end and a second end, said first end having a hollow, flexible, circular sleeve circumferentially containing at least one longitudinal male connecting element, said circular sleeve formed in a manner so as to receive said encapsulated inner layer from said male coupling element, and having a shoulder receiving portion circumferentially formed around said first end so as to receive said shoulder from said male coupling element, and at least two barbed shaped receiving grooves formed circumferentially inside said female hollow, flexible, circular sleeve and said male connecting element longitudinally forming a face adjacent to a second energy transmission line encapsulated in a second encapsulating inner layer forming said other end;

so that when said circular body from said male coupling element is inserted in said circular sleeve from said female coupling element, said male connecting element in said female coupling element fits snugly within said female connecting element in said male coupling element, said barb shaped receiving grooves of said female coupling element fit with said barb shaped elements of said male coupling element, said face of said female coupling element firmly contacts and seals said rigid lip of said face of said male coupling element and said shoulder of said male coupling element further contacts and seals against said shoulder receiving portion of said female coupling element and energy transmission is completed from said male to said female connecting elements.

BRIEF DESCRIPTION OF THE DRAWINGS

Although the drawings furnished with this invention purport to show the best mode contemplated by the inventor at the filing of this invention, they are not meant to further restrict the invention to these specific embodiments. Other embodiments will be obvious from the further description contained in the "Details of the Invention" to follow.

DETAILS OF THE INVENTION

Figure 1:
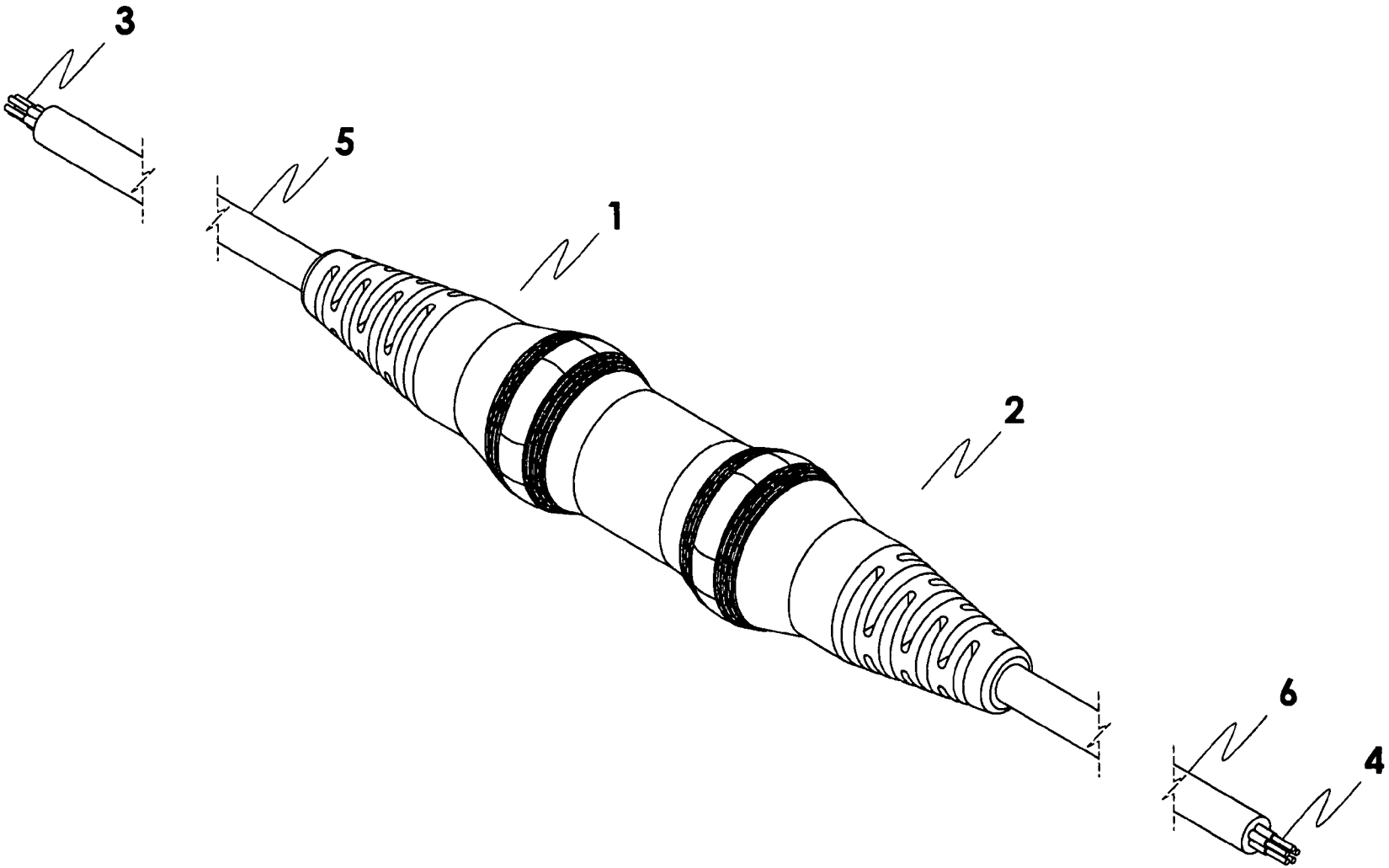
FIG. 1 is a side perspective view of a typical energy transmission coupling element of this invention.

Looking now specifically at the drawings, FIG. 1 is a side perspective view of a typical energy transmitting device as described in this invention. In this showing 1 is the female portion of the coupling element and 2 the male portion. All of the elements are contained within each portion so when they are mated together as shown, the device is essentially moisture resistant and safe to use within a moist environment. The incoming and outgoing cable elements are shown as 5 and 6 containing wires or energy transmission elements shown as 3 and 4. These cable elements are cut-away to show a length of such wiring as required. One of said cable ends would be attached to an energy source and the other to the user equipment.

Figure 2:
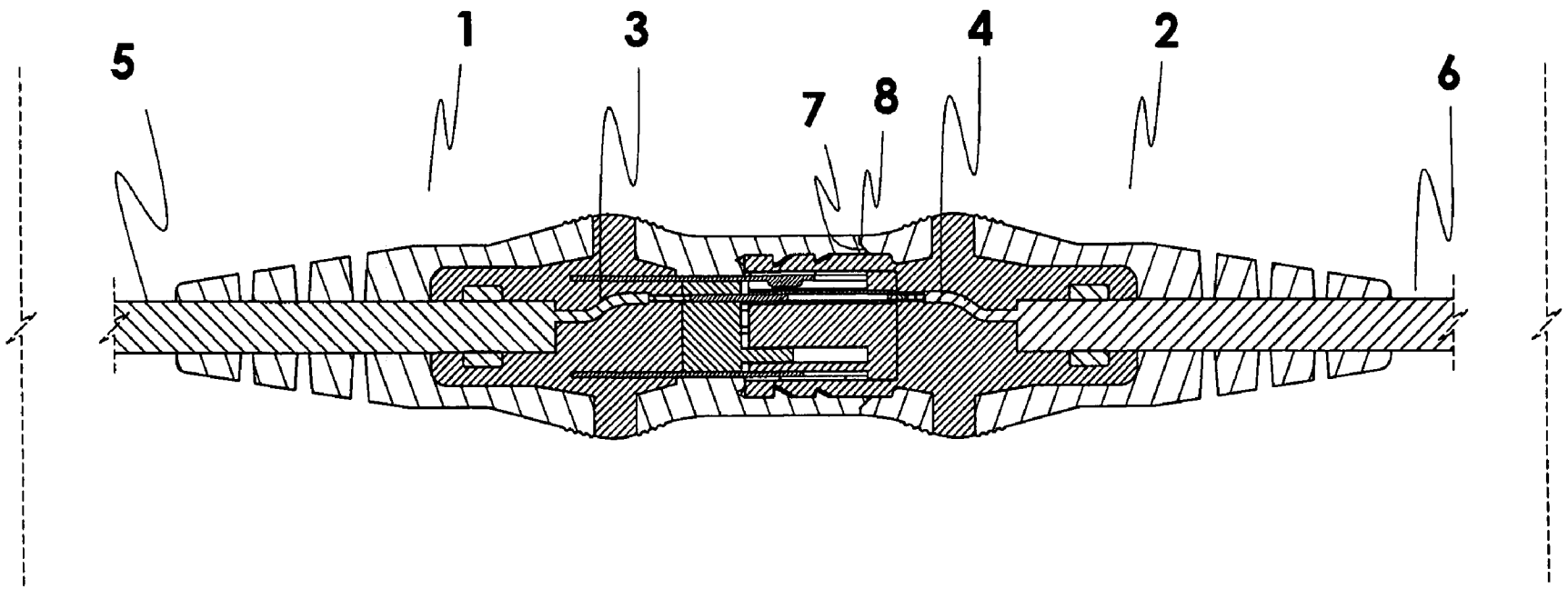
FIG. 2 is a side cut-away view of the elements of FIG. 1 showing interior, coupling details.

FIG. 2 is a side view cut-away showing of the element of FIG. 1 with detail of construction and joining capabilities. Here we can see the female portion 1 and the male portion 2. Shoulder pre-seal elements are shown circumferentially as 7 and 8 located at the joint wherein 1 and 2 are connected. This joint is formed by the mating of the angled shoulder element of said female coupling element 1 with the angled shoulder receiving element of said male coupling element 2. Cable elements are shown as 5 and 6 which contain wires 3 and 4.

Figure 3:
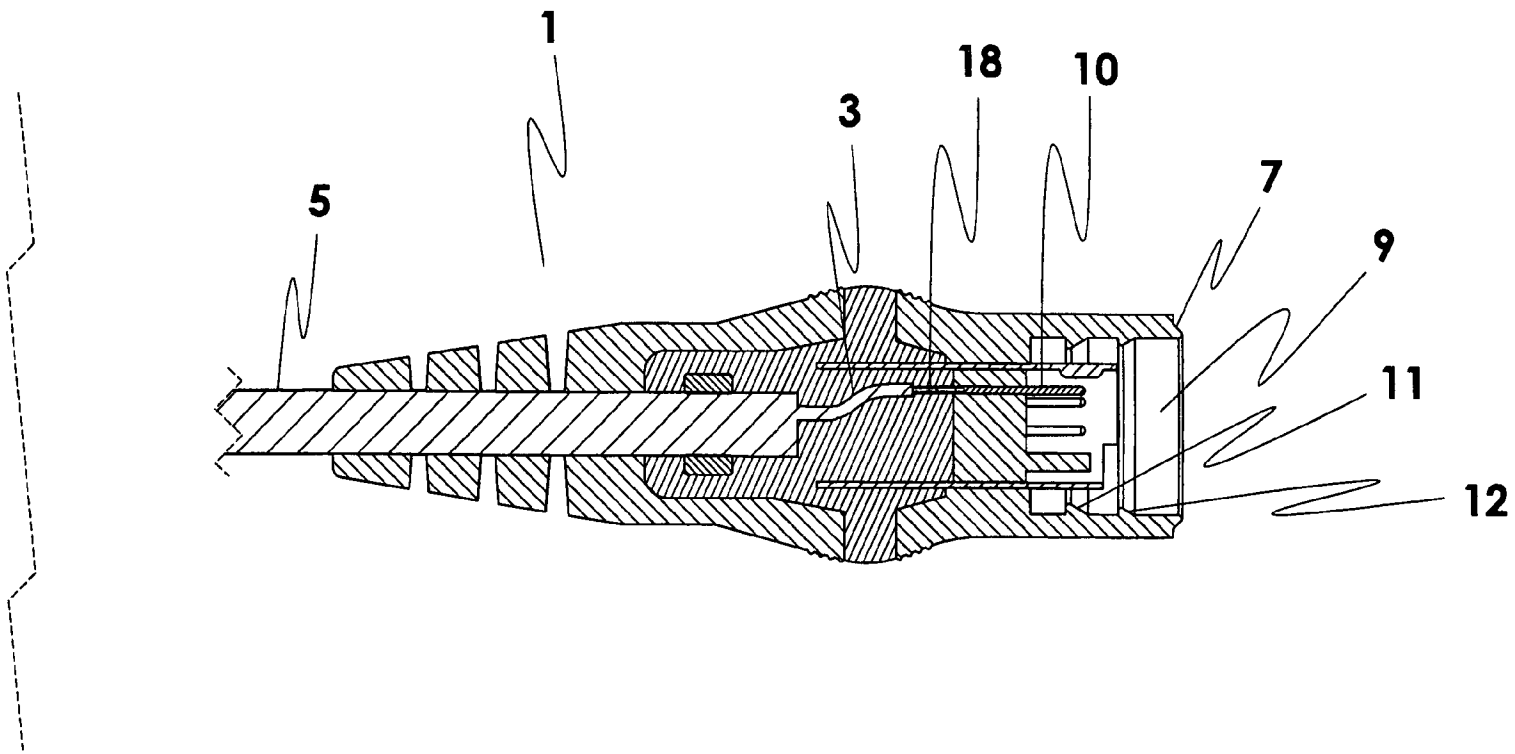
FIG. 3 is a side cut-away and detail view of the female portion of the coupling element shown in FIGS. 1 and 2.

FIG. 3 is a detailed view cut-away of just the female portion 1 of the coupling element of this invention. Cable 5 contains wires 3 for energy transmission one of which is terminated to a connector element 10 at 18 and is ready for connection when joined with the male coupling element 2 of FIG. 2. A pair of circumferential barbed shaped holding elements are shown as 11 and 12 and the circumferentially formed shoulder element is shown as 7.

Figure 4:
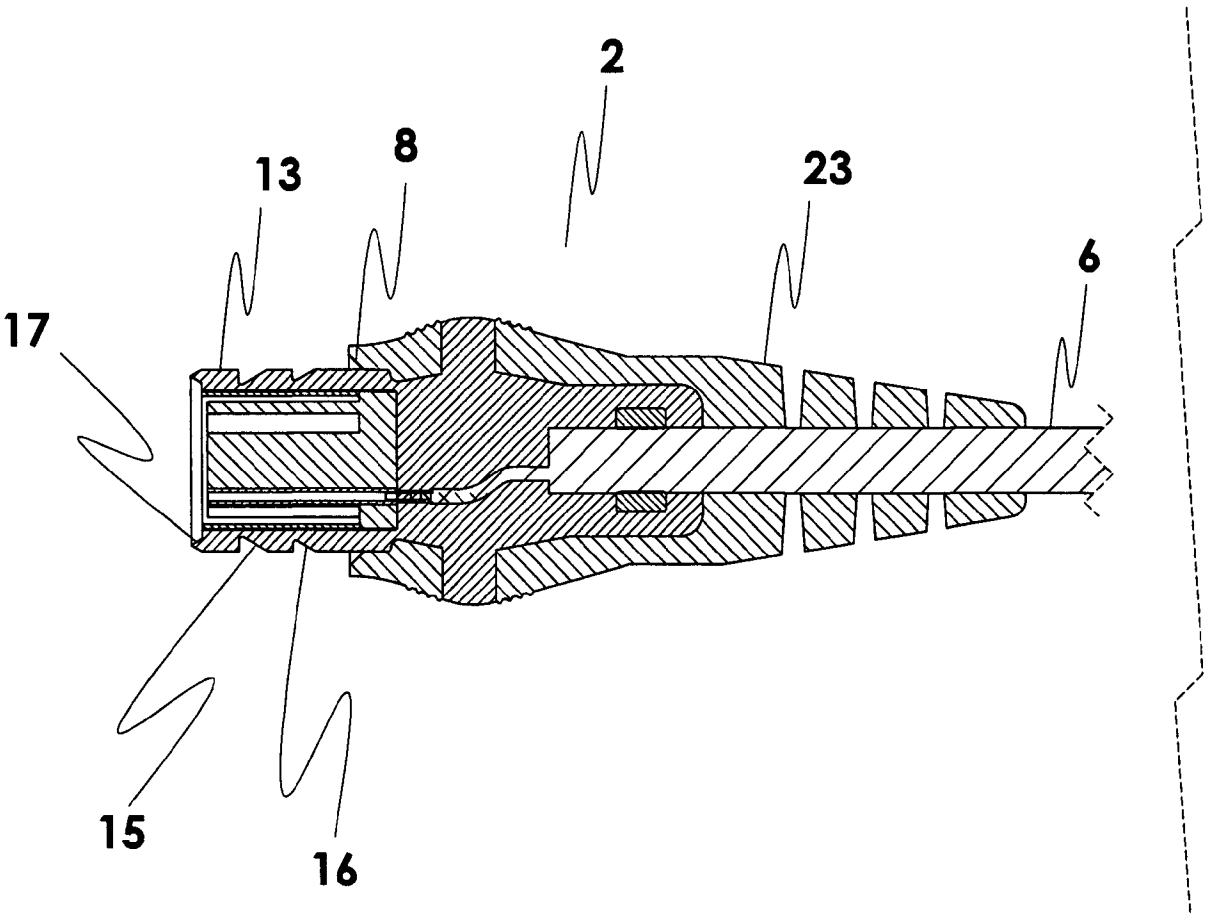
FIG. 4 is a side cut-away and detail view of the male portion of the coupling element shown in FIGS. 1 and 2.

FIG. 4 is a detailed view cut-away of just the male portion 2 of the coupling element of this invention. The rigid circular body is shown as 13 and it is this element that is inserted into the flexible, circular sleeve 9 of FIG. 3 (not shown here). An angled shoulder receiving element shown as 8 is circumferentially formed on the end of the flexible outer layer element 23 and is designed to receive the circumferential shoulder element 7 from FIG. 3 (not shown here). A pair of circumferentially formed barbed shape elements 15 and 16 are designed to fit into the circumferentially formed barbed shape receiving grooves 11 and 12 of FIG. 3 (not shown here). A rigid lip 17 is the main and final element that will seal this device from the ingress of moisture. This lip is designed to press tightly into the face of the corresponding female coupling element and is well seen and described further in FIG. 5 to follow.

Figure 5:
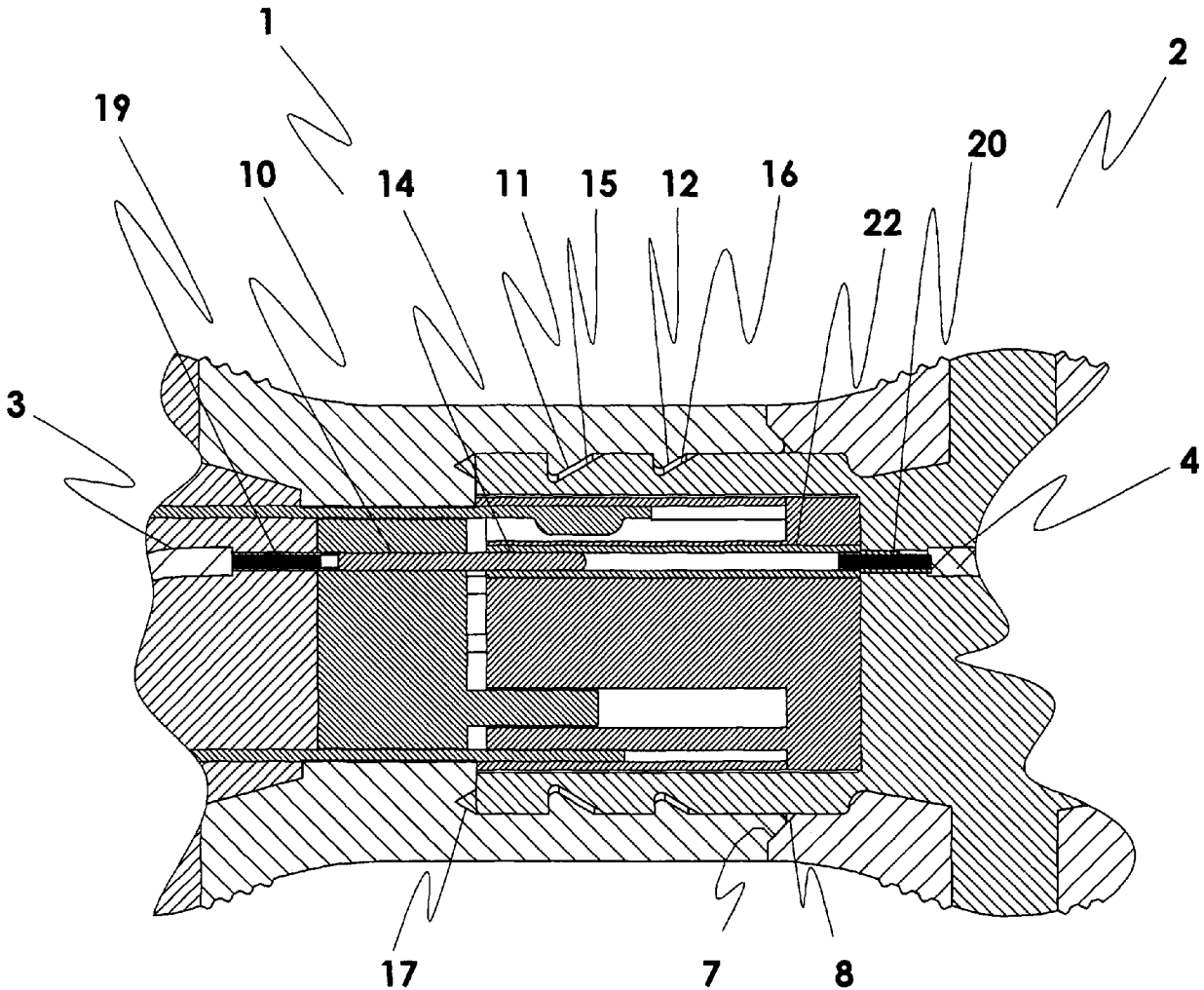
FIG. 5 is an even more detailed side cut-away view of the coupled elements from FIG. 2.

FIG. 5 is a larger scaled drawing of the male and female coupling elements shown in FIG. 2. In this particular drawing 1 is the female coupling element having received the male coupling element 2. The circumferentially formed shoulder and shoulder receiving elements are shown as 7 and 8, the circumferentially formed male barb shaped holding elements of the female coupling element are shown as 11 and 12 and the female barb shaped holding elements of the male coupling element are shown as 15 and 16. When mated these barb shaped elements provide the holding force necessary to maintain the final moisture seal obtained when the circumferentially formed rigid lip 17 formed on said rigid circular body of said male coupling element is impressioned into said flexible face 18 of said female coupling element. Wires for energy transmission shown as 3 and 4 contained in cables 5 and 6 (not shown) are terminated to connector elements 10 and 22 at 19 and 20 and said connector elements are shown connected at 14. It is the unique combination of angled shoulders, barb shaped elements, rigid lip and flexible face that provides such a unique easily accomplished connection and so tight a formation that superior water resistance is achieved.

These connector elements are molded in two parts. The first interior molded part of the connectors are known as the pre-mold and utilize a hard rigid plastic that encapsulates the off the shelf connectors or hardware of the connector elements. The second exterior molded element commonly known as the over-mold is then applied and encapsulates all or part of the pre-molded element with typically softer flexible plastic. Connector elements that are contained within these devices are conventional, off-the-shelf products and are securely encapsulated therein along with the appropriate cable ends. Since these connectors are intended to be used within a moist environment it is necessary to design the molded parts to join securely in order to form the superior moisture resistance. Elements that make up the pre-mold elements of this invention are generally formed from rigid plastic-like materials including nylons, polypropylene, polyvinyl chloride, and polycarbonates, among others. The choice of plastic materials used within the ambit of this invention are generally dictated by the process capabilities, wear characteristics, and material costs. The over-mold plastic preferences include thermal plastic rubbers, thermal plastic elastomers and polyurethanes, for example.

There are a host of common connectors systems having male and female gender configurations that can be purchased directly off-the-shelf and encased in the manner taught within this invention so as to provide secure moisture resistance such as din connectors, mini-din connectors, USB connectors, high speed communication connectors and fiber optic connectors to name just a few are also envisioned along with fluid transmission lines. Industries that can use such moisture resistant connections include telecommunications, computer, automotive, medical, electrical and manufacturers of electrical devices as well as power and communications boating equipment. Any connector elements that can be encapsulated in the manner taught within this invention can be destined for use in commercial, private and military venues.

I claim:

1. A highly moisture resistant connector system having two coupling elements comprising:

a. a first male coupling element formed in a longitudinal end-to-end formation and having an energy transmitting line element contained and encapsulated therein, comprising in order a first end comprising said line for transmitting said energy and a second end formed longitudinally into a circular body, said circular body comprising an outer layer and an encapsulating inner layer, wherein said outer layer further contains a shoulder formed with said circular body, said inner layer further containing encapsulated longitudinally therein at least one female receiving element having two ends, one of said ends being connected to said energy transmitting line and the other of said ends terminating at a face ending on said inner layer, wherein a rigid lip is formed circumferentially on said face and wherein at least two barbed shaped elements are formed circumferentially thereon;

b. a second female coupling element formed in a longitudinal end-to-end formation and having an energy transmitting line contained and encapsulated therein, comprising in order a first end and a second end, said first end having a hollow, flexible, circular sleeve circumferentially containing at least one longitudinal male connecting element, said circular sleeve formed in a manner so as to receive said encapsulated inner layer from said male coupling element, and having a shoulder receiving portion circumferentially formed around said first end so as to receive said shoulder from said male coupling element, and at least two barbed shaped receiving grooves formed circumferentially inside said female hollow, flexible, circular sleeve and said male connecting element longitudinally forming a face adjacent to a second energy transmission line encapsulated in a second encapsulating inner layer forming said other end;

so that when said circular body from said male coupling element is inserted in said circular sleeve from said female coupling element, said male connecting element in said female coupling element fits snugly within said female connecting element in said male coupling element, said barb shaped receiving grooves of said female coupling element fit with said barb shaped elements of said male coupling element, said face of said female coupling element firmly contacts and seals said rigid lip of said face of said male coupling element and said shoulder of said male coupling element further contacts and seals against said shoulder receiving portion of said female coupling element and energy transmission is completed from said male to said female connecting elements.

2. The highly moisture resistant coupling system of claim 1 wherein said energy transmission is a communications system comprising at least one communication cable located within each of said male and female coupling elements, each of said cables having at least one wire therein, whereby said wire in said male coupling element is terminated to a female connector element thereon and the wire in said female coupling element is terminated to a male connector element thereon, and said connector elements are encapsulated within said coupling elements, so that when said male coupling element is mated to said female coupling element a communication line is formed by the mating of said male connector element to said female connector element.

3. The highly moisture resistant coupling system of claim 1 where said energy transmission is an electrical system comprising at least one electrical cable located within each of said male and female coupling elements, each of said cables having at least one wire therein, whereby said wire in said male coupling element is terminated to a female connector element thereon and the wire in said female coupling element is terminated to a male connector element thereon, and said connector elements are encapsulated within said coupling elements, so that when said male coupling element is mated to said female coupling element an electrical line is formed by the mating of said male connector element to said female connector element.

4. The highly moisture resistant coupling system of claim 1 where said connector elements contain at least one barb shaped holding element for improved tightness of fit between male and female elements such that moisture resistance is greatly improved.

5. The highly moisture resistant coupling system of claim 1 wherein said encapsulation of said male connection point comprises a rigid polymer.

6. The highly moisture resistant coupling system of claim 1 wherein said encapsulation of said female connection point comprises a flexible polymer.

7. The coupling system of claim 1 wherein said male and female coupling elements can be repeatedly disconnected and subsequently reconnected without deterioration of the moisture resistant elements thus maintaining said high moisture resistance.

8. The element of claims 4 wherein said rigid polymer is selected from the group comprising a polypropylene, a nylon, a polyvinyl chloride or a polycarbonate.

9. The element of claim 5 wherein said flexible polymer is selected from the group comprising a thermal plastic rubber, a thermal plastic elastomer or a polyurethane.

* * * * *